US010035251B2

(12) United States Patent
Moore

(10) Patent No.: US 10,035,251 B2
(45) Date of Patent: Jul. 31, 2018

(54) WEAR INDICATING SYSTEM

(71) Applicant: Caterpillar Inc., Peoria, IL (US)

(72) Inventor: Cody T. Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 446 days.

(21) Appl. No.: 14/940,172

(22) Filed: Nov. 13, 2015

(65) Prior Publication Data

US 2016/0067857 A1 Mar. 10, 2016

(51) Int. Cl.

| | |
|---|---|
| ***B25D 9/14*** | (2006.01) |
| ***B25D 17/08*** | (2006.01) |
| ***B25D 9/00*** | (2006.01) |
| ***B25D 17/26*** | (2006.01) |

(52) U.S. Cl.

CPC ..... *B25D 17/08* (2013.01); *B25D 9/00* (2013.01); *B25D 17/26* (2013.01); *B25D 2250/101* (2013.01); *B25D 2250/105* (2013.01)

(58) Field of Classification Search

CPC ..... B25D 17/26; B25D 17/08; B25D 9/00; B25D 2250/101; B25D 2250/105

See application file for complete search history.

(56) References Cited

U.S. PATENT DOCUMENTS

| | | | | |
|---|---|---|---|---|
| 4,171,560 | A * | 10/1979 | Garrett | B23P 11/00 228/175 |
| 5,451,110 | A * | 9/1995 | Gams, Jr. | B02C 2/06 116/208 |
| 6,328,116 | B1 | 12/2001 | Hurskainen et al. | |
| 6,510,904 | B1 * | 1/2003 | Tyrrell | B25D 17/08 173/128 |
| 7,438,139 | B2 | 10/2008 | Pillers, II | |
| 8,590,633 | B2 * | 11/2013 | Berghauser | B25D 17/06 173/109 |
| 8,955,616 | B2 * | 2/2015 | Ostensson | B25D 11/005 173/19 |
| 9,592,598 | B2 * | 3/2017 | Moore | B25D 9/145 |
| 2011/0005786 | A1 * | 1/2011 | Ostensson | B25D 11/005 173/20 |
| 2013/0081837 | A1 | 4/2013 | Jagdale et al. | |
| 2014/0262407 | A1 * | 9/2014 | Moore | B25D 9/145 173/208 |
| 2015/0376970 | A1 * | 12/2015 | Hughes | E21B 33/085 166/84.1 |

FOREIGN PATENT DOCUMENTS

| | | |
|---|---|---|
| CN | 102296951 | 12/2011 |
| CN | 204059448 | 12/2014 |

* cited by examiner

*Primary Examiner* — Andrew M Tecco

(57) ABSTRACT

A hydraulic hammer is provided. The hydraulic hammer includes a housing member. The hydraulic hammer also includes a power cell disposed within the housing member. The power cell includes an outer casing. The hydraulic hammer also includes a work tool operatively coupled with the power cell. The hydraulic hammer also includes one or more bushing parts arranged within the outer casing of the power cell. The one or more bushing parts are adapted to guide the work tool during an operation of the hydraulic hammer. The one or more bushing parts include a first surface and a second surface spaced apart from the first surface. The hydraulic hammer also includes a wear indicating system for indicating a wear of the one or more bushing parts with respect to the first surface. The wear indicating system includes a first passage and a second passage.

1 Claim, 5 Drawing Sheets

WEAR INDICATING SYSTEM

TECHNICAL FIELD

The present disclosure relates to a hydraulic hammer, and more particularly to a wear indicating system for one or more bushing parts of a hydraulic hammer.

BACKGROUND

Hydraulic hammers are used at various work sites for fracturing objects, such as rocks, concrete, asphalt, frozen ground, and other materials. The hydraulic hammers include bushing parts that act as a guiding agent. The bushing parts are provided between a power cell and a work tool of the hydraulic hammer. After the hydraulic hammers are put to use, the bushing parts may wear over a period of time. If the bushing parts wear beyond a predefined wear limit, the bushing parts may require immediate repair or replacement to avoid wear and abrasion of the work tool and the power cell of the hydraulic hammer.

In some cases, the work tool may have to be removed from the hydraulic hammer to identify a worn out condition of the bushing parts. A maintenance personnel at customer's end may have to refer to service manuals to check the predefined wear limits of the bushing parts. However, this method of inspecting a worn out condition of the bushing parts is time consuming and prone to errors. Further, conventional methods for identifying wear of the bushing parts require special measurement tools. The identification methods also require skilled labor for accurate identification of the wear of the bushing parts.

U.S. Pat. No. 8,590,633, hereinafter referred to as the '633 patent describes a wear indicator for a beat piece of a powered hammer. The powered hammer includes a beat piece support structure to support the beat piece. The beat piece is repetitively struck by the reciprocating ram, which repetitively strikes an end of the tool to transfer momentum of the ram to the tool. The beat piece support structure allows the beat piece to slide between a first forward position and a second rearward position. When the powered hammer is not in operation, a first end of a rod having indicia located a predetermined distance from the first end is inserted into the tool holder to slide the beat piece to the second rearward position so that a distance between the front end of the tool holder and the indicia indicates an amount of wear on the beat piece. However, the '633 patent does not disclose a wear indicating system for identifying a worn out condition of a bushing part associated with the powered hammer.

SUMMARY OF THE DISCLOSURE

In one aspect of the present disclosure, a hydraulic hammer is provided. The hydraulic hammer includes a housing member. The hydraulic hammer also includes a power cell disposed within the housing member. The power cell includes an outer casing. The hydraulic hammer also includes a work tool operatively coupled with the power cell. The hydraulic hammer also includes one or more bushing parts arranged within the outer casing of the power cell. The one or more bushing parts are adapted to guide the work tool during an operation of the hydraulic hammer. The one or more bushing parts include a first surface and a second surface spaced apart from the first surface. The first surface and the second surface define a wall of the one or more bushing parts. The hydraulic hammer also includes a wear indicating system for indicating a wear of the one or more bushing parts with respect to the first surface. The wear indicating system includes a first passage disposed at a pre-defined distance from the first surface of the one or more bushing parts. The first passage has a first end and a second end. The first passage directs a lubricant used in the hydraulic hammer when a pre-defined thickness between the first surface and the first end of the first passage is worn. The wear indicating system also includes a second passage disposed within the outer casing of the power cell. The second passage extends from an inner surface of the outer casing to a bottom surface of the outer casing. The second passage is in contact with the second end of the first passage. The second passage directs the lubricant out of the outer casing of the power cell.

Other features and aspects of this disclosure will be apparent from the following description and the accompanying drawings.

DETAILED DESCRIPTION

Figure 1:
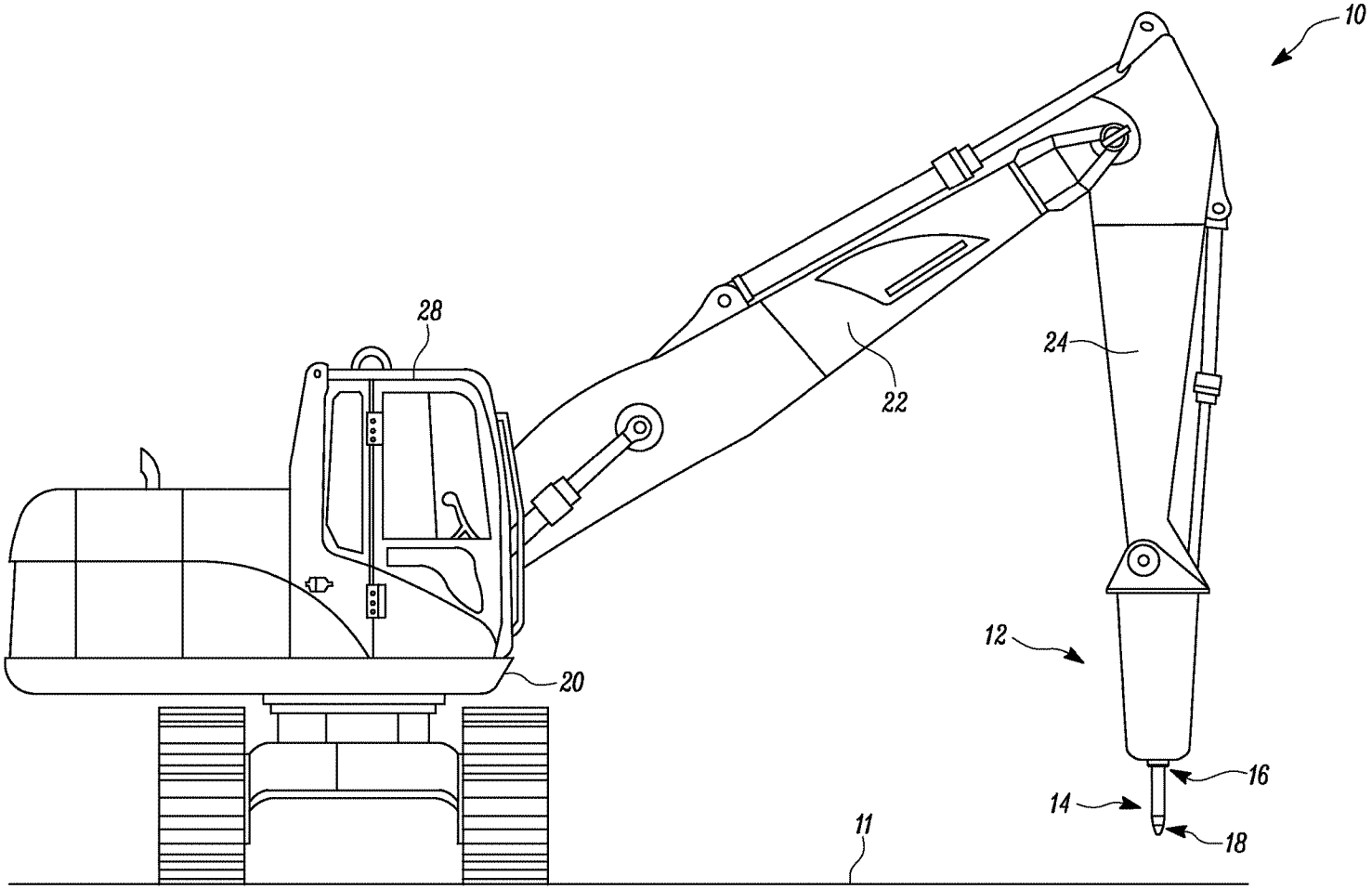
FIG. 1 is a side view of an exemplary machine having a hydraulic hammer attached thereto, in accordance with the concepts of the present disclosure.

Wherever possible, the same reference numbers will be used throughout the drawings to refer to the same or the like parts. Referring to FIG. 1, an exemplary machine 10 is depicted, according to one embodiment of the present disclosure. The machine 10 is embodied as a tracked drill machine. A hydraulic hammer 12 is associated with the machine 10. The hydraulic hammer 12 includes a work tool 14. The work tool 14 has a top portion 16 attached to the hydraulic hammer 12. A bottom portion 18 of the work tool 14 contacts with a work surface 11 during an operation of the hydraulic hammer 12. The work tool 14 is used for fracturing/breaking rocks and penetrating ground surfaces. The work tool 14 has an outer diameter "D1" (shown in FIG. 2). The work tool 14 may be selected based on a type of operation the hydraulic hammer 12 performs. Accordingly, the work tool 14 may include any one of a blunt type, chisel type, and cone type work tool.

In one example, the hydraulic hammer 12 may be operated by a hydraulic system (not shown) associated with the machine 10. Alternatively, the hydraulic hammer 12 may be operated by a pneumatic system (not shown) associated with the machine 10. Further, it can be contemplated to use other types of machines and carriers to power the hydraulic hammer 12.

The machine 10 includes a frame 20, a boom member 22, and a stick member 24. The boom member 22 and the stick member 24 articulate relative to the frame 20 in order to change an orientation and/or position of the hydraulic hammer 12, with respect to the work surface 11. The machine 10 includes input devices (not shown) located within a cab 28 of the machine 10. The input devices may be used by an operator to operate the hydraulic hammer 12.

Figure 2:
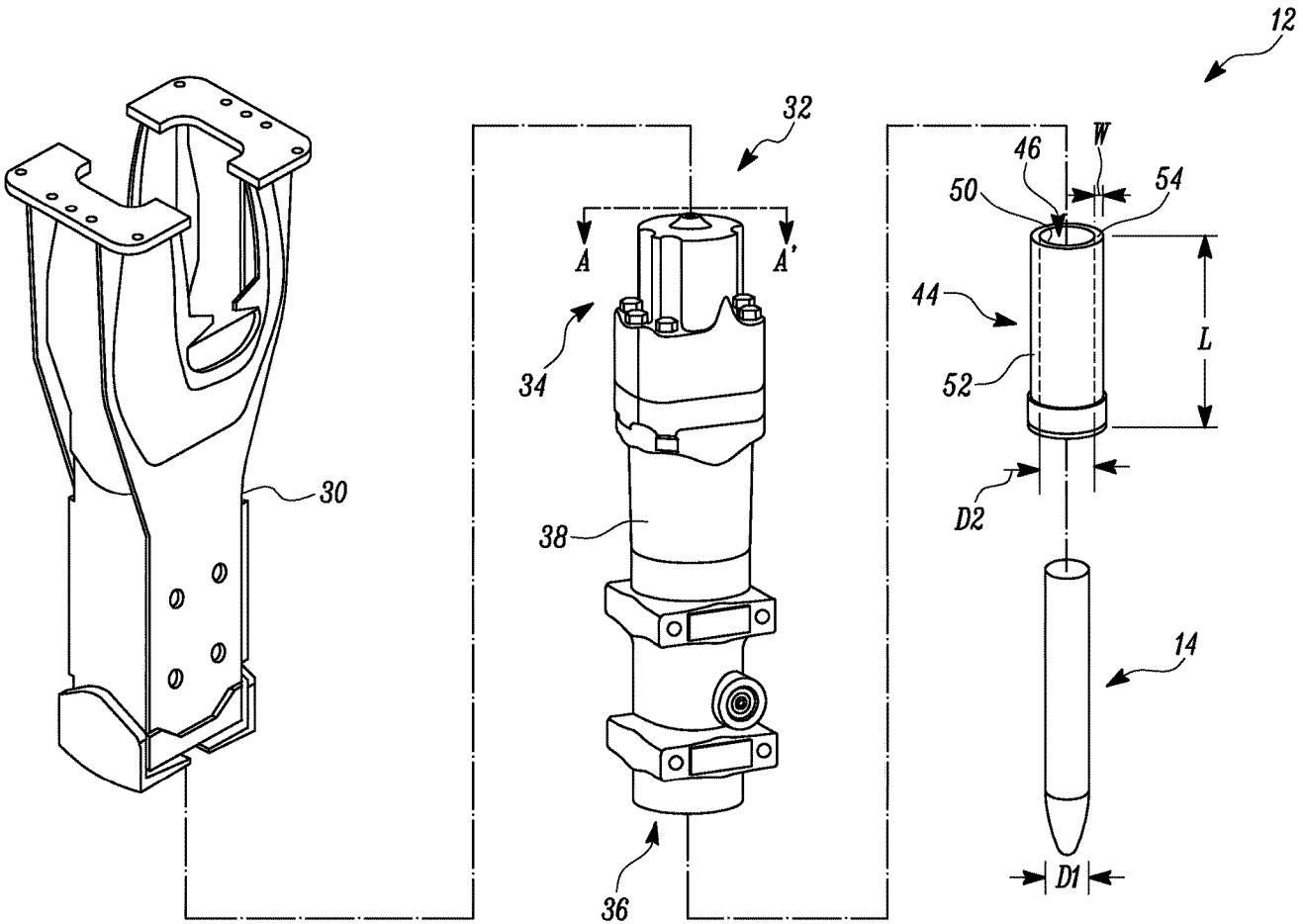
FIG. 2 is an exploded view of the hydraulic hammer, in accordance with the concepts of the present disclosure.

FIG. 2 illustrates an exploded view of the hydraulic hammer 12, according to one embodiment of the present disclosure. The hydraulic hammer 12 includes a housing member 30. A power cell 32 is disposed within the housing member 30. During the operation of the hydraulic hammer 12, the power cell 32 drives the work tool 14 so that the work tool 14 may perform functions that are consistent with the present disclosure. The power cell 32 includes a first end 34 and a second end 36. The work tool 14 is coupled to the second end 36 of the power cell 32.

Figure 3:
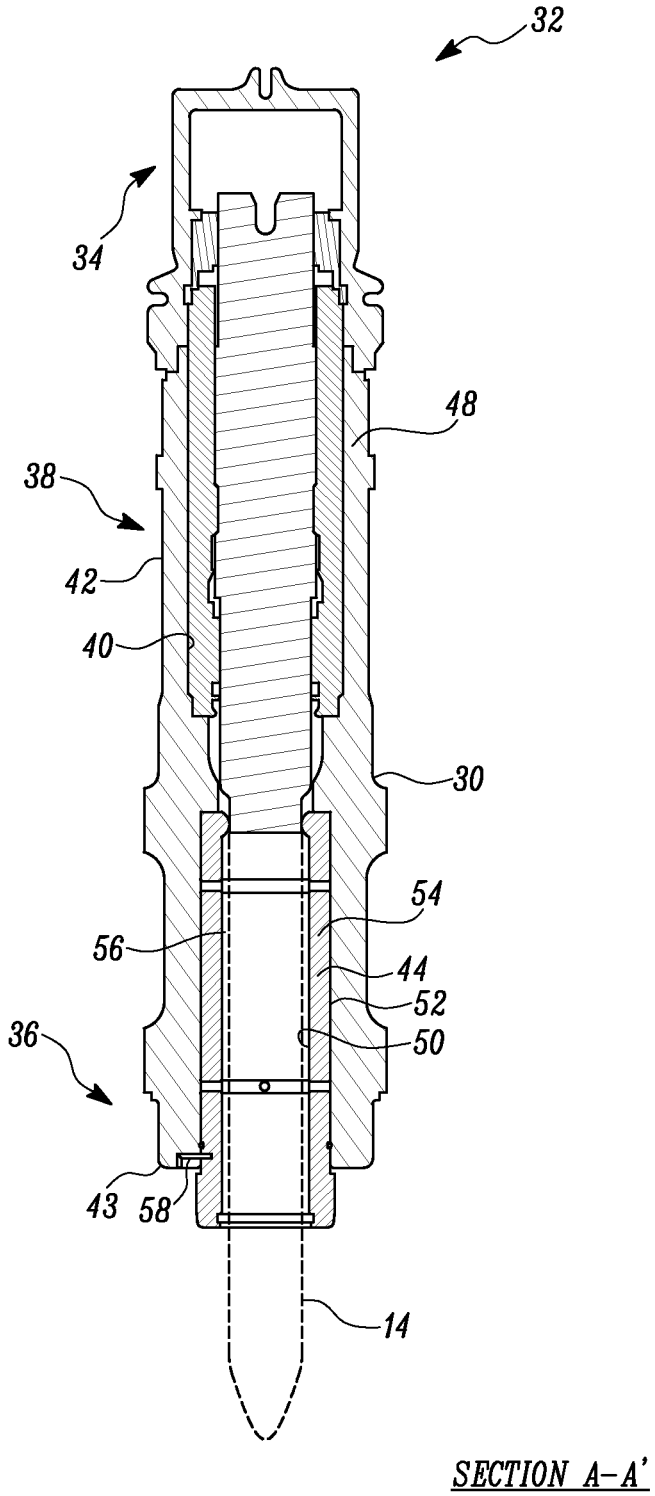
FIG. 3 is a cross sectional view of a power cell of the hydraulic hammer taken along a cutting plane A-A' of FIG. 2, shown in accordance with the concepts of the present disclosure.

Referring to FIG. 3, the power cell 32 includes an outer casing 38. The outer casing 38 houses one or more components of the power cell 32. The components may include a cylinder, piston, and the like. The outer casing 38 includes a bottom surface 43. The outer casing 38 includes an inner surface 40 and an outer surface 42. The outer surface 42 is disposed opposite to the inner surface 40. The inner surface 40 and the outer surface 42 define a wall 48 of the outer casing 38.

The hydraulic hammer 12 includes one or more bushing parts 44 arranged within the outer casing 38 of the power cell 32. The work tool 14 is received within a hollow portion 46 of the bushing part 44. For illustrative purposes, the work tool 14 is shown using imaginary lines in the accompanying figure. In the present disclosure, a single bushing part 44 is disposed between the outer wall 48 and the work tool 14, at the second end 36 of the power cell 32. The bushing part 44 extends in a downward direction from the power cell 32. The bushing part 44 guides the work tool 14 inside the power cell 32 during the operation of the hydraulic hammer 12.

Referring to FIG. 2, the bushing part 44 has a first surface 50, hereinafter interchangeably referred to as an inner surface 50. The bushing part 44 further includes a second surface 52, hereinafter referred to as outer surface 52. The outer surface 52 is spaced apart from the inner surface 50. A distance between the inner surface 50 and the outer surface 52 defines a wall 54 of the bushing part 44. The wall 54 has a thickness "W". It can be contemplated that the thickness "W" of the bushing part 44 may vary along a length "L" of the bushing part 44, based on dimensions of the hydraulic hammer 12 and the work tool 14. Further, the bushing part 44 may be manufactured using a conventional manufacturing method, without any limitations. Further, the bushing part 44 may be made of any metal and/or non-metal known in the art, without limiting the scope of the present disclosure.

The bushing part 44 has a pre-defined inner diameter "D2". Further, a clearance 56 (see FIG. 3) is defined between the outer diameter "D1" of the work tool 14 and the inner diameter "D2" of the bushing part 44. In order to provide a smooth movement of the work tool 14 within the bushing part 44 and to reduce wear and tear of the work tool 14, a lubricant is provided within the hydraulic hammer 12. The lubricant may be provided by a manual lubrication method and/or an automating lubrication method using a lubrication system known in the art. The lubricant may be of different types specific to the application of the machine 10. In one example, the lubricant may be a grease based lubricant. The lubricant fills the clearance 56 between the bushing part 44, and the work tool 14.

During the operation of the hydraulic hammer 12, the power cell 32 is subjected to impact loads due to contact of the work tool 14 with the work surface 11. Such impact loads, if transferred to the hydraulic hammer 12, may cause wear and tear of various components of the hydraulic hammer 12, such as the power cell 32, the work tool 14, and the bushing part 44. More particularly, the inner surface 50 of the bushing part 44 that is in contact with the work tool 14 is subjected to wear during the operation of the hydraulic hammer 12.

Figure 4:
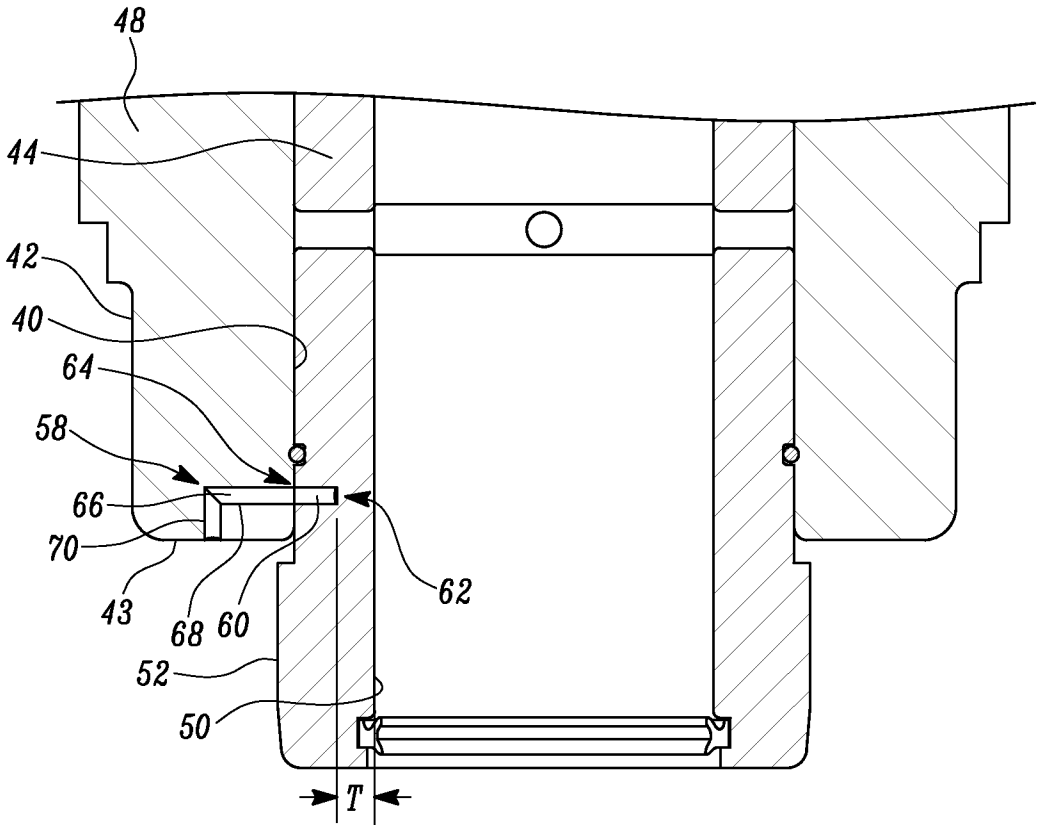
FIG. 4 is a cross sectional view of a portion of the power cell and a bushing part associated therewith, shown in accordance with the concepts of the present disclosure.
Figure 5:
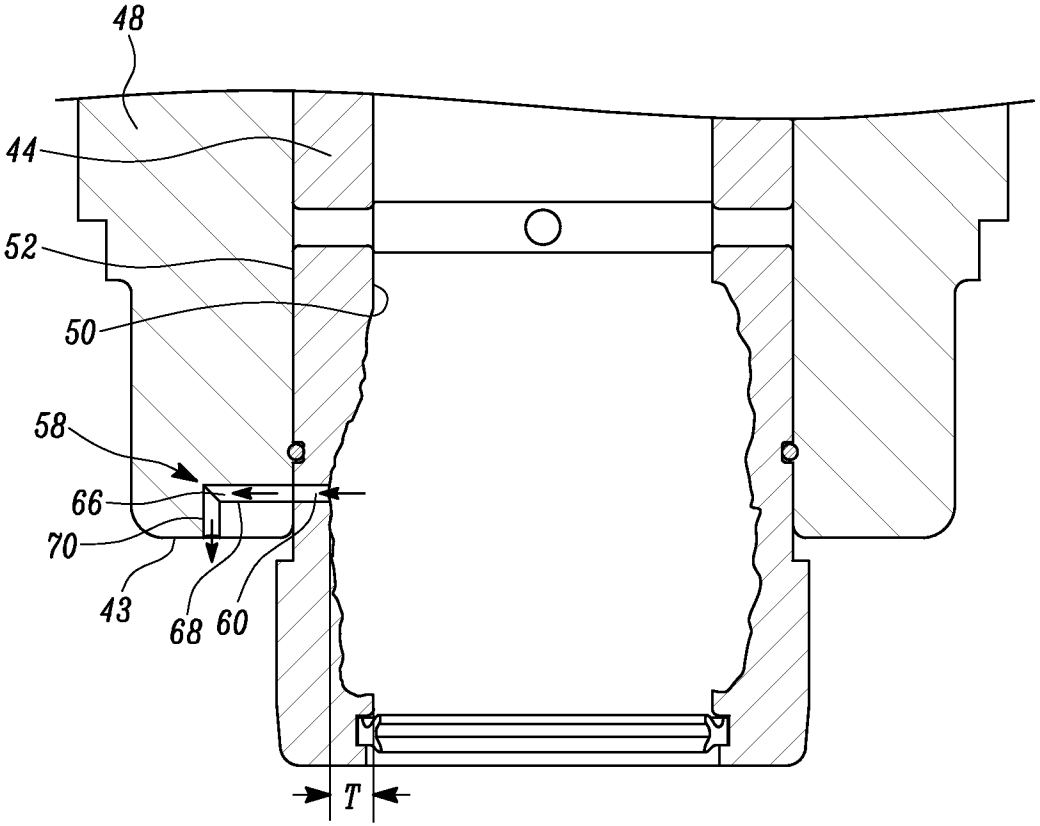
FIG. 5 is a cross sectional view illustrating a worn out condition of the bushing part, shown in accordance with the concepts of the present disclosure.

Referring to FIGS. 4 and 5, the present disclosure relates to a wear indicating system 58. The wear indicating system 58 provides an indication to a personnel, such as a maintenance personnel, regarding a worn out condition of the bushing part 44 with respect to the inner surface 50. In one embodiment, the wear indicating system 58 may be provided close to a bottom end of the bushing part 44.

Referring to FIG. 4, the wear indicating system 58 includes a first passage 60. The first passage 60 is embodied as a blind hole that extends from the outer surface 52 of the bushing part 44. In one example, the bushing part 44 may be drilled to form the first passage 60. The first passage 60 has a first end 62 and a second end 64. The first end 62 is disposed at a pre-defined thickness "T" from the inner surface 50 of the bushing part 44. Further, the second end 64 of the first passage 60 is defined on the outer surface 52 of the bushing parts 44.

Further, the wear indicating system 58 includes a second passage 66. The second passage 66 is disposed within the outer casing 38 of the power cell 32. In one example, the second passage 66 is provided close to the second end 36 of the power cell 32. The second passage 66 is embodied as an L-shaped passage provided in the wall 48 of the outer casing 38. The second passage 66 includes a first portion 68 and a second portion 70. The first portion 68 and the second portion 70 are generally perpendicular to each other. The first portion 68 extends from the inner surface 40 of the outer casing 38, towards the outer surface 42. The second portion 70 extends from the bottom surface 43 of the outer casing 38 towards the first portion 68. A diameter of the first portion 68 and the second portion 70 of the second passage 66 is equal to a diameter of the first passage 60. The second passage 66 is adapted to be in fluid communication with the first passage 60.

As disclosed above, the inner surface 50 of the bushing part 44 is subjected to wear during the operation of the hydraulic hammer 12. As shown in FIG. 5, when the inner surface 50 of the bushing part 44 wears up to or beyond the pre-defined thickness "T", the first passage 60 is exposed to the lubricant present in the clearance 56 (see FIG. 3). Thus, the lubricant present in the clearance 56 is introduced in the first passage 60. Once the first passage 60 is filled with the lubricant, the lubricant flows in to the second passage 66. The second passage 66 directs the lubricant out of the outer casing 38. A flow of the lubricant through each of the first and second passages 60, 66 is shown using arrows "F" in the accompanying figure. A leakage of the lubricant from the second passage 66 provides a visual indication regarding a worn out condition of the bushing part 44.

INDUSTRIAL APPLICABILITY

During operation, the components of the hydraulic hammer 12 are subjected to impact loads due to the contact of the work tool 14 with the work surface 11. More particularly, the bushing part 44 of the hydraulic hammer 12 is subjected to wear during the operation of the hydraulic hammer 12. Excessive wear of the bushing part 44 causes misalignment of the work tool 14 with the power cell 32, thereby leading to a premature failure of the hydraulic hammer 12.

The wear indicating system 58 is associated with the bushing part 44. The wear indicating system 58 provides the visual indication that the bushing part 44 has worn beyond a predetermined wear limit. Accordingly, the maintenance personnel, is notified that the bushing part 44 may have to be replaced/repaired. Thus, any possible failures of the components of the hydraulic hammer 12 may be prevented, thereby reducing downtime of the machine 10.

The wear indicating system 58 disclosed herein acts as a wear indicator, and provides a cost effective and easy to implement solution for wear indication. The wear indicating system 58 eliminates the need of removal of the work tool 14 from the hydraulic hammer 12 for identifying the worn out condition of the bushing part 44. Based on a leakage of the lubricant from the outer casing 38, the maintenance personnel are notified whether the bushing part 44 requires repair and/or replacement. The wear indicating system 58 eliminates requirement of costly and time consuming indication apparatus for identification of the worn out condition of the bushing part 44.

While aspects of the present disclosure have been particularly shown and described with reference to the embodiments above, it will be understood by one skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A hydraulic hammer comprising:

a housing member;

a power cell disposed within the housing member, the power cell having an outer casing;

a work tool operatively coupled with the power cell;

one or more bushing parts arranged within the outer casing of the power cell, the one or more bushing parts adapted to guide the work tool during an operation of the hydraulic hammer, the one or more bushing parts having a first surface and a second surface spaced apart from the first surface, the first surface and the second surface defining a wall of the one or more bushing parts; and a wear indicating system for indicating a wear of the one or more bushing parts with respect to the first surface, the wear indicating system comprising:

a first passage disposed at a pre-defined distance from the first surface of the one or more bushing parts, the first passage having a first end and a second end, wherein the first passage directs a lubricant used in the hydraulic hammer when a pre-defined thickness between the first surface and the first end of the first passage is worn; and a second passage disposed within the outer casing and extending from an inner surface of the outer casing to a bottom surface of the outer casing, the second passage configured to contact with the second end of the first passage, and configured to direct the lubricant out of the outer casing.

* * * * *